US012256819B2

(12) United States Patent
Foster

(10) Patent No.: US 12,256,819 B2
(45) Date of Patent: Mar. 25, 2025

(54) HANDCRAFTED CASES LINED WITH MATERIAL TO CARRY WIGS, UNITS AND HAIR PIECES

(71) Applicant: Marshette Foster, Charlotte, NC (US)

(72) Inventor: Marshette Foster, Charlotte, NC (US)

( * ) Notice: Subject to any disclaimer, the term of this patent is extended or adjusted under 35 U.S.C. 154(b) by 0 days.

(21) Appl. No.: 18/159,251

(22) Filed: Jan. 25, 2023

(65) Prior Publication Data

US 2023/0232951 A1 Jul. 27, 2023

Related U.S. Application Data

(60) Provisional application No. 63/302,743, filed on Jan. 25, 2022.

(51) Int. Cl.
*A45C 11/00* (2006.01)
*A41G 3/00* (2006.01)

(52) U.S. Cl.
CPC ..... *A45C 11/00* (2013.01); *A41G 3/00* (2013.01)

(58) Field of Classification Search
CPC ..... A45C 11/00
USPC ..... 150/113, 112; 217/3 R, 3 BC; 206/581; 190/109
See application file for complete search history.

(56) References Cited

U.S. PATENT DOCUMENTS 2,574,089 A * 11/1951 Cochran ..... A45C 13/02 190/125
2,649,939 A * 8/1953 Donald ..... A45C 5/02 190/125
3,337,112 A * 8/1967 Thurston ..... B65D 5/32 217/3 R
5,228,547 A * 7/1993 Yoo ..... A45C 3/00 190/111
8,439,174 B1 * 5/2013 Miranda ..... A45C 5/14 383/4
8,893,730 B2 * 11/2014 Pun ..... A45C 5/005 206/823
8,967,379 B2 * 3/2015 Kinskey ..... B25H 3/022 190/110
2007/0086550 A1 * 4/2007 Kaise ..... H04B 1/1027 375/348
2012/0161408 A1 * 6/2012 Sidhu ..... A45C 13/28 280/47.38

(Continued)

FOREIGN PATENT DOCUMENTS

WO WO-2010038244 A1 * 4/2010 ..... A45C 13/02

*Primary Examiner* — Rafael A Ortiz
(74) *Attorney, Agent, or Firm* — Jeffrey C. Watson, Esq.; Grell & Watson Patent Attorneys LLC

(57) ABSTRACT

A case to carry wigs, units, and hair pieces includes a container device. The container device has a length, a width, and a depth. The container device includes a hinged lid on an open top portion. The hinged lid rotates between a closed position and an option position, where the closed position seals the open top portion, and the option position provides access to the open top portion. At least one divider is on an inside of the container device. The at least one divider is configured to divide the inside of the case into compartments. Each compartment is configured to store at least one of the wigs, the units or the hair pieces. A liner material is on the inside of the container device. The liner material is configured to protect the wigs, the units, the hair pieces, and combinations thereof, stored in the inside of the container device.

1 Claim, 13 Drawing Sheets

(56) References Cited

U.S. PATENT DOCUMENTS

| | | | | |
|---|---|---|---|---|
| 2015/0265352 | A1* | 9/2015 | Johnson | A61J 15/0026 224/676 |
| 2017/0086550 | A1* | 3/2017 | Caro | A45C 13/26 |
| 2021/0386169 | A1* | 12/2021 | Jackson | A45C 11/32 |
| 2022/0142319 | A1* | 5/2022 | Strippoli | A45C 13/03 |

* cited by examiner

HANDCRAFTED CASES LINED WITH MATERIAL TO CARRY WIGS, UNITS AND HAIR PIECES

CROSS-REFERENCE TO RELATED APPLICATIONS

This application claims benefit to U.S. Provisional Patent Application No. 63/302,743 filed on Jan. 25, 2022, entitled HANDCRAFTED CASES LINED WITH MATERIAL TO CARRY WIGS, UNITS AND HAIR PIECES, which is incorporated by reference in its entirety.

FIELD OF THE DISCLOSURE

The present disclosure relates to wigs, units and hair pieces, and devices for transporting or carrying such wigs, units and hair pieces. More specifically, the instant disclosure relates to a handcrafted case lined with material to carry such wigs, units and hair pieces.

BACKGROUND

Generally speaking, a wig, also known as a unit or hair piece, is a head or hair accessory made from human hair, animal hair, or synthetic fiber. A wig, unit, or hair piece is designed to be a covering for the head made of real or artificial hair, and is typically worn by people for adornment or by people trying to conceal their baldness, or in England by judges and barristers in courts of law. Some people wear wigs to disguise baldness. A wig may also be used as a less intrusive and less expensive alternative to medical therapies for restoring hair or for a religious reason.

The instant disclosure recognizes the need for transporting and/or storing such wigs, units or hair pieces. Currently, there are no products on the market designed to securely and safely transport and/or store such wigs, units or hair pieces. Wigs, units or hair pieces can be rather delicate and rather costly to fix or replace. In addition, wearers of such wigs, units or hair pieces like to be discreet about their use. As such, there is clearly a need to provide a device designed specifically for transporting and/or storing such wigs, units or hair pieces securely and safely.

The instant disclosure may be designed to address at least certain aspects of the problems or needs discussed above by providing a handcrafted case lined with material to carry wigs, units and/or hair pieces.

SUMMARY

The present disclosure may solve the aforementioned limitations of the currently available means or devices for carrying, transporting and/or storing wigs, units or hair pieces, by providing a handcrafted case lined with material to carry wigs, units and hair pieces. The handcrafted cases lined with material to carry wigs, units and hair pieces may generally include a container device. The container device may have a length, a width, and a depth. The container device may include a hinged lid on an open top portion. The hinged lid may rotate between a closed position and an option position, where the closed position may seal the open top portion, and the option position may provide access to the open top portion. At least one divider may be on an inside of the container device. The at least one divider may be configured to divide the inside of the case into compartments. Each compartment may be configured to store at least one of the wigs, the units or the hair pieces. A liner material may be on the inside of the container device. The liner material may be configured to protect the wigs, the units, the hair pieces, and combinations thereof, stored in the inside of the container device.

One feature of the disclosed handcrafted case lined with material to carry wigs, units and hair pieces may be that it can be configured to provide a secure and safe way to transport and store the wigs, the units, the hair pieces, or combinations thereof.

Another feature of the disclosed handcrafted case lined with material to carry wigs, units and hair pieces may be that it can be configured to be used to store and protect the wigs, the hair pieces, the units, or combinations thereof from dust and damage.

In select embodiments of the disclosed handcrafted case lined with material to carry wigs, units and hair pieces, the case may be a handcrafted case. In select embodiments, this handcrafted case may be made from wood. However, the disclosure is not so limited, and the container device of the case may be made from other materials similar to wood, or plastics, rubbers, the like, etc.

In select embodiments of the disclosed handcrafted case lined with material to carry wigs, units and hair pieces, the dividers may be oriented lengthwise inside of the container device along the length of the container device. In select embodiments of the case, the container device may include a single length wise divider. In other select embodiments of the case, the container device may include 2 or more length wise dividers.

One feature of the disclosed handcrafted case lined with material to carry wigs, units and hair pieces may be the liner material may be around each of the at least one dividers.

Another feature of the disclosed handcrafted case lined with material to carry wigs, units and hair pieces may be that each of the at least one dividers may be held in place in lengthwise orientation via frictional forces between ends of the dividers and liner material on left and right sides of the inside of the container device.

In select embodiments of the disclosed handcrafted case lined with material to carry wigs, units and hair pieces, the liner material may be positioned on a bottom surface of the inside of the container device.

In select embodiments of the disclosed handcrafted case lined with material to carry wigs, units and hair pieces, the liner material may be positioned on a left side of the inside of the container device.

In select embodiments of the disclosed handcrafted case lined with material to carry wigs, units and hair pieces, the liner material may be positioned on a right side of the inside of the container device.

In select embodiments of the disclosed handcrafted case lined with material to carry wigs, units and hair pieces, the liner material may be positioned on a back side of the inside of the container device.

In select embodiments of the disclosed handcrafted case lined with material to carry wigs, units and hair pieces, the liner material may be positioned on a front side of the inside of the container device.

In select embodiments of the disclosed handcrafted case lined with material to carry wigs, units and hair pieces, the liner material may be positioned on a bottom side of the hinged lid.

In select embodiments of the disclosed handcrafted case lined with material to carry wigs, units and hair pieces, the liner material may be positioned around each of the at least one dividers.

In select embodiments of the disclosed handcrafted case lined with material to carry wigs, units and hair pieces, the liner material may be positioned: on a bottom surface of the inside of the container device; on a left side of the inside of the container device; on a right side of the inside of the container device; on a back side of the inside of the container device; on a bottom side of the hinged lid; on a front side of the inside of the container device; and around each of the at least one divider.

In select embodiments of the disclosed handcrafted case lined with material to carry wigs, units and hair pieces, the liner material may be a padded fabric material. The padded fabric material may be any padded fabric material, including, but not limited to, a padded satin fabric material.

Another feature of the disclosed handcrafted case lined with material to carry wigs, units and hair pieces may be that it can include at least one hinge. The hinge or hinges may be connected between a back side of the container device and the hinged lid. In select embodiments, 2 hinges may be connected between the back side of the container device and the hinged lid. In select embodiments, each of the at least one hinge may include a bottom portion and a top portion. The bottom portion may be connected on a groove in the back side of the inside of the container device. The top portion may be connected to the hinged lid.

Another feature of the disclosed handcrafted case lined with material to carry wigs, units and hair pieces may be the inclusion of locking clasps. The locking clasps may be configured to secure the lid to the case. In select embodiments, the locking clasps may be positioned on a front of the container device.

Another feature of the disclosed handcrafted case lined with material to carry wigs, units and hair pieces may be the inclusion of a handle. The handle may be configured for carrying the case. In select embodiments, the handle may be positioned on a front of the container device.

In select embodiments of the disclosed handcrafted case lined with material to carry wigs, units and hair pieces, the container device may be configured as an airplane travel size. The airplane travel size may have the length of the container device of 22 inches and the width of the container device of 14 inches. In this airplane travel size embodiment of the handcrafted case, at least one divider may be included. The at least one divider may be configured for creating at least two compartments on the inside of the container device. In select embodiments of this airplane travel size embodiment of the handcrafted case, a single divider may be provided for creating two compartments on the inside of the container device.

In select embodiments of the disclosed handcrafted case lined with material to carry wigs, units and hair pieces, the container device may be configured as a standard case size. The standard case size may have the length of the container device of 22 inches and the width of the container device of 18 inches. In this standard case size embodiment of the handcrafted case, at least two dividers may be included. The at least two dividers may be configured for creating at least three compartments on the inside of the container device. In select embodiments of this standard case size embodiment of the handcrafted case, two dividers may be provided for creating three compartments on the inside of the container device.

In another aspect, the instant disclosure embraces the handcrafted cases lined with material to carry wigs, units and hair pieces in any embodiment and/or combination of embodiments shown and/or described herein.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

Figure 1:
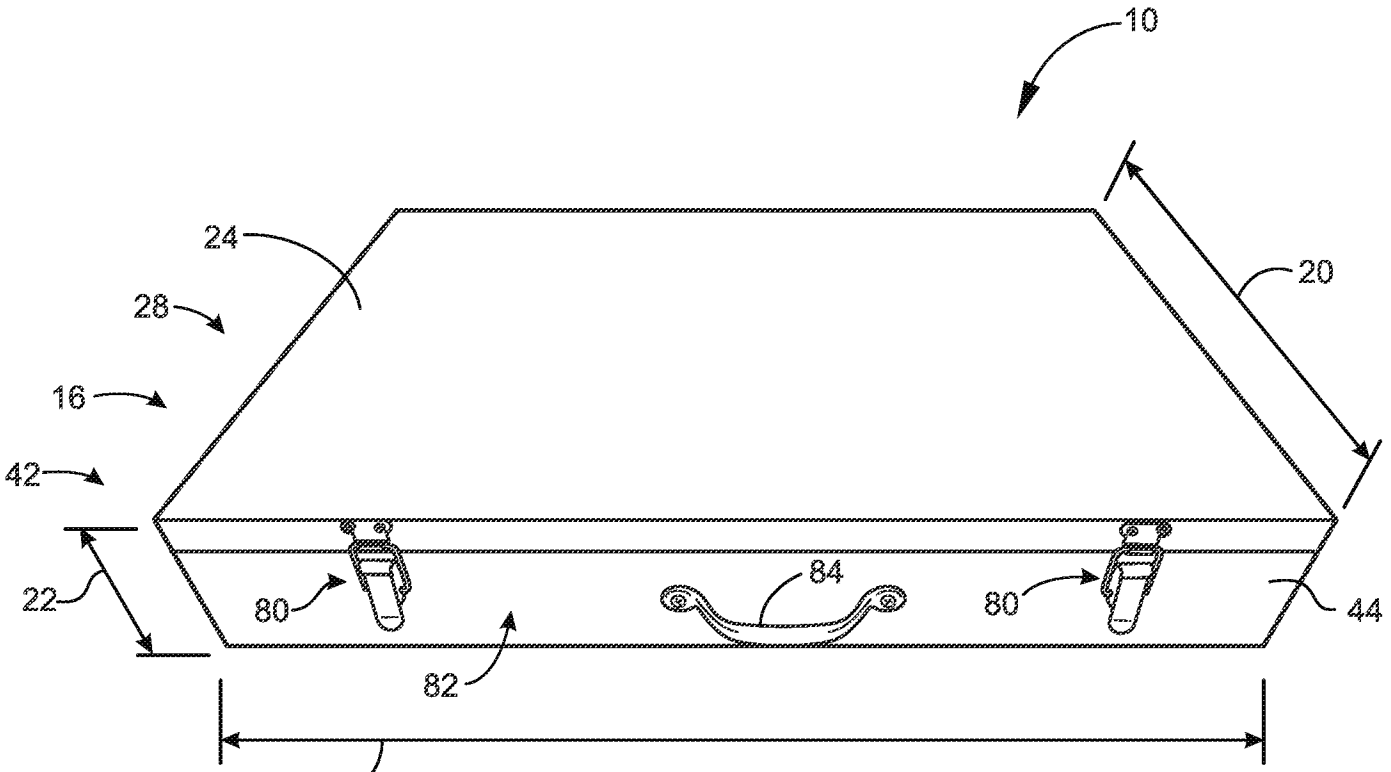
FIG. 1 is a top front perspective view of the disclosed case to carry hair pieces according to select embodiments of the instant disclosure with the lid closed and locked into place via the locking clasps.
Figure 2:
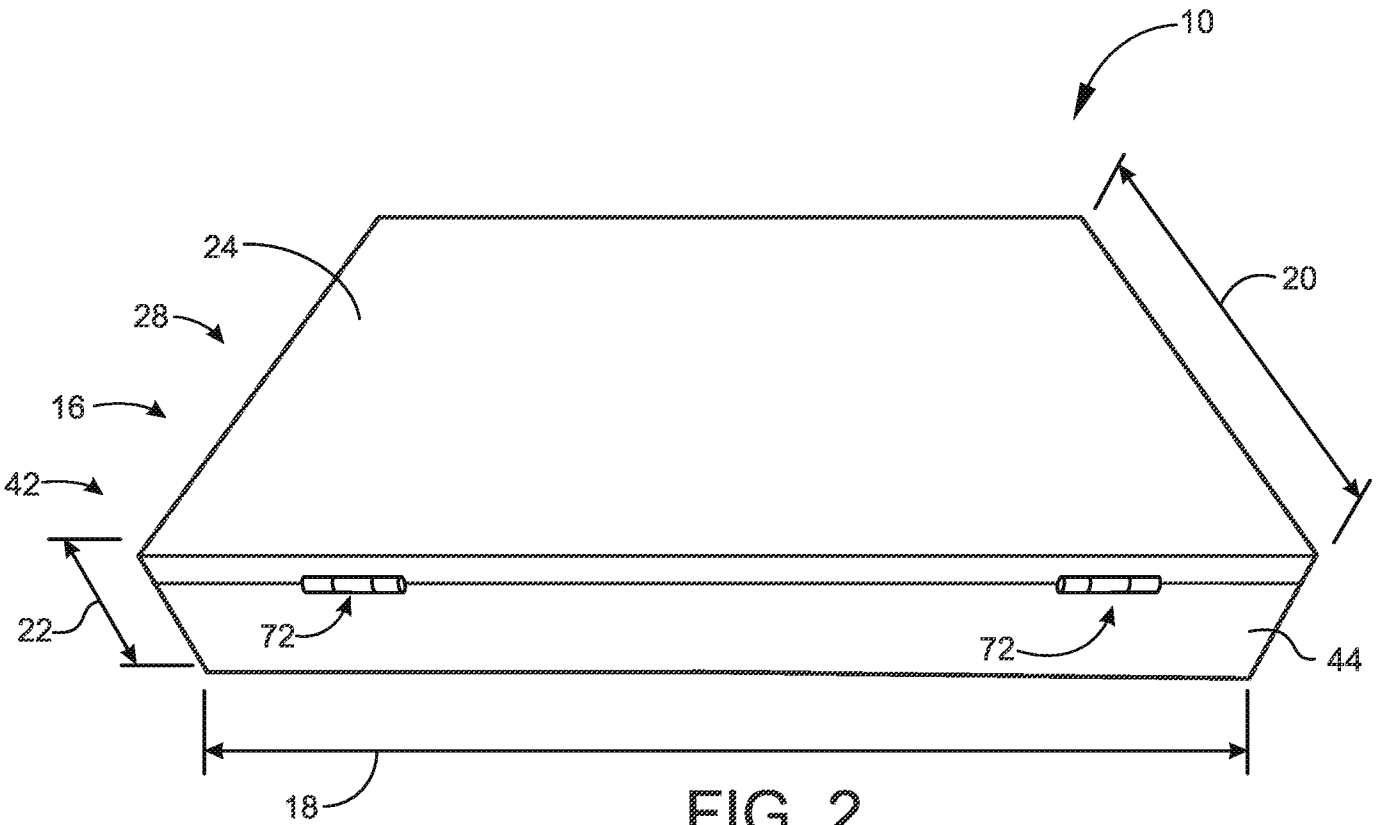
FIG. 2 is a top back perspective view of the case to carry hair pieces of FIG. 1 with the lid closed.
Figure 3:
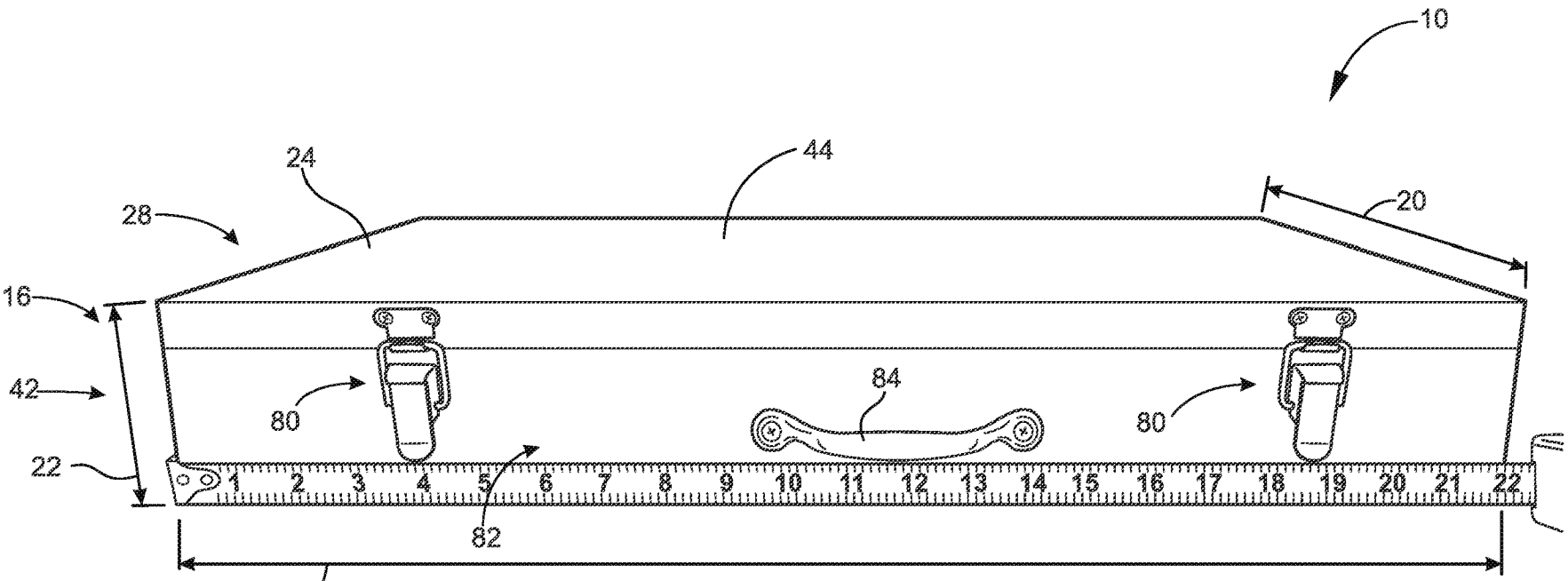
FIG. 3 is a front view of the case to carry hair pieces of FIG. 1 with the lid closed and locked into place via the locking clasps.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-13, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples.

Referring to FIGS. 1-13, the present disclosure may solve the aforementioned limitations of the currently available means or devices for carrying, transporting and/or storing wigs, units or hair pieces, by providing case 10 lined with material 38 to carry wigs 12, units 13 hair pieces 14 (see FIG. 8), the like, and/or combinations thereof. Case 10 lined with liner material 38 to carry wigs 12, units 13 and/or hair pieces 14 may generally include container device 16. Container device 16 may have length 18, width 20, and depth 22. Container device 16 may include hinged lid 24 on open top portion 26 of container device 16. Hinged lid 24 may rotate between closed position 28 (see FIGS. 1-3) and option position 30 (see FIGS. 4, 6-11), where closed position 28 may seal open top portion 26 of container device 16, and option position 30 may provide access to open top portion 26 of container device 16. At least one divider 32 may be on inside 34 of container device 16. The at least one divider 32 may be configured to divide inside 34 of container device 16 into compartments 36. Each compartment 36 may be configured to store at least one of the wigs 12, the units 13 and/or the hair pieces 14. Liner material 38 may be on inside 34 of container device 16. Liner material 38 may be configured to protect the wigs 12, the units 13, the hair pieces 14, the like, and/or combinations thereof, stored in inside 34 of container device 16.

One feature of case 10 lined with liner material 38 to carry wigs 12, units 13, hair pieces 14, the like, and/or combinations thereof may be that it can be configured to provide a secure and safe way to transport and store such wigs 12, units 13, hair pieces 14, the like, and/orr combinations thereof.

Another feature of case 10 lined with liner material 38 to carry wigs 12, units 13, hair pieces 14, the like, and/or combinations thereof may be that it can be configured to be used to store and protect such wigs 12, hair pieces 14, units 13, the like, and/or combinations thereof from dust and damage.

In select embodiments of case 10 lined with liner material 38 to carry wigs 12, units 13, hair pieces 14, the like, and/or combinations thereof, case 10 may be handcrafted case 42, as shown in the Figures. In select embodiments, this handcrafted case 42 may be made from wood 44. However, the disclosure is not so limited, and container device 16 of case 10 may be made from other materials similar to wood, or plastics, rubbers, the like, etc.

In select embodiments of case 10 lined with liner material 38 to carry wigs 12, units 13, hair pieces 14, the like, and/or combinations thereof, dividers 32 may be oriented lengthwise 46 inside of container device 16, i.e., along length 18 of container device 16. In select embodiments of case 10, container device 16 may include single length wise divider 48 (see FIGS. 7 and 8, like for use in airplane travel size 86 version of case 10 shown in FIG. 12. In other select embodiments of case 10, container device 16 may include 2 or more length wise dividers 50 (see FIGS. 4-6, and 10-11, live for use in standard case size 88 version of case 10 shown in FIG. 13). However, the disclosure is not so limited, and any number of dividers 32 may be provided in inside 34 of container device 16 for creating any number of compartments 36 on inside 34 of container device 16.

Figure 11:
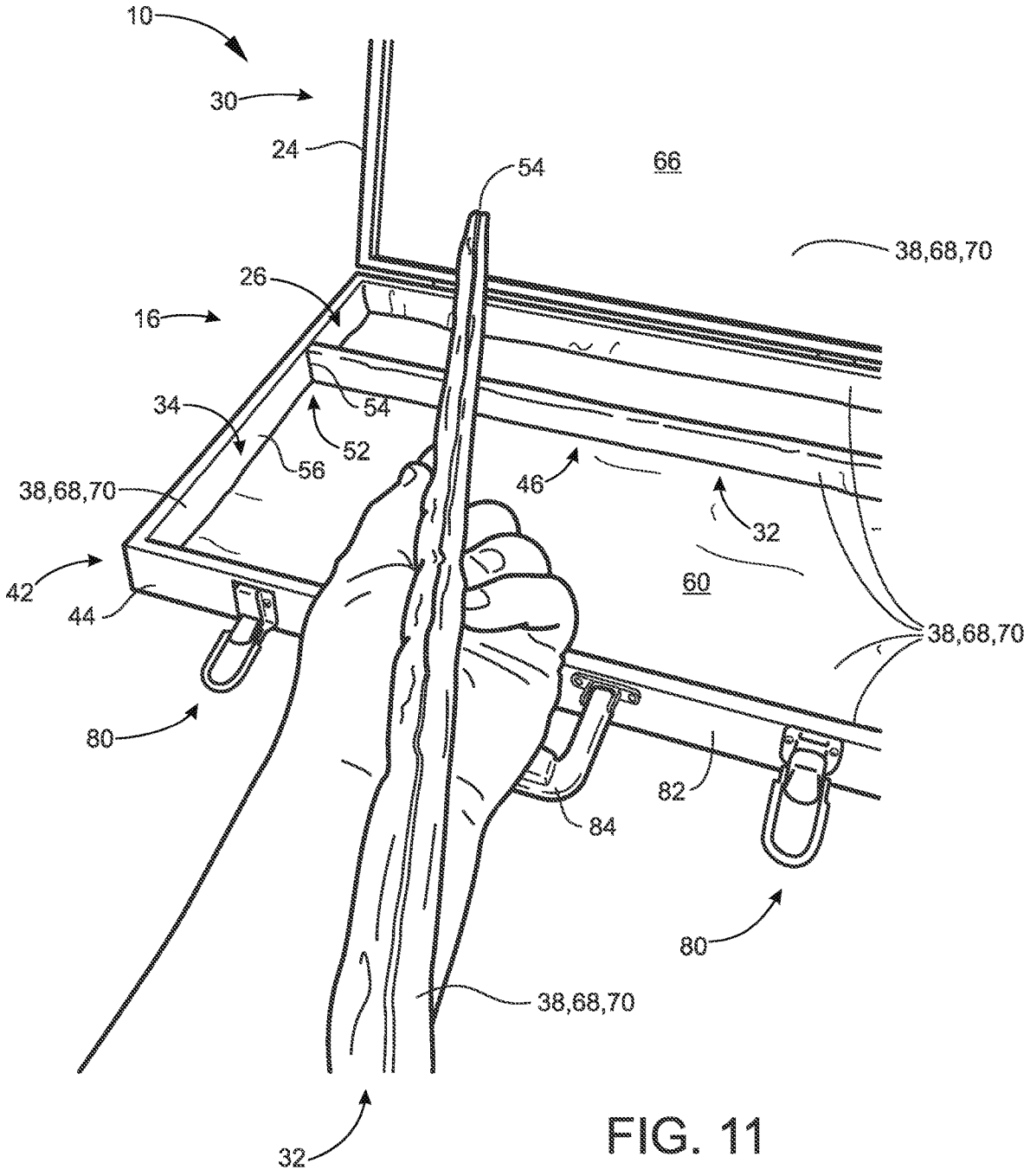
FIG. 11 is a top view of one of the dividers for the disclosed case to carry hair pieces according to select embodiments removed from the case showing the material liner thereon.

Referring now specifically to FIG. 11, one feature of case 10 lined with liner material 38 to carry wigs 12, units 13, hair pieces 14, the like, and/or combinations thereof may be that liner material 38 may be around each of the at least one divider 32. With liner material wrapped around each of the at least one dividers 32, another feature of case 10 lined with liner material 38 to carry wigs 12, units 13, hair pieces 14, the like, and/or combinations thereof may be that each of the at least one dividers 32 may be held in place in lengthwise orientation 46 via frictional forces 52. Frictional forces 52 may be between ends 54 of dividers 32 and liner material 38 on left side 56 and right side 58 of inside 34 of container device 16. This feature may allow the user or operator of case 10 to easily insert, move, and remove dividers 32 on inside 34 of container device 16. As such, the user or operator may easily customize compartments 36 on inside 34 of container device 16, including creating any size and/or number of compartments 36 on inside 34 of container device 16

One feature of case 10 lined with liner material 38 to carry wigs 12, units 13, hair pieces 14, the like, and/or combinations thereof may be the inclusion of liner material 38 on inside 34 of container device 16. Liner material 38 may be designed for protecting such wigs 12, units 13, hair pieces 14, the like, and/or combinations thereof placed within case 10, like during transportation and/or storage. Liner material may be included on any surfaces within inside 34 of container device 16. In select embodiments of case 10 lined with liner material 38 to carry wigs 12, units 13, hair pieces 14, the like, and/or combinations thereof, liner material 38 may be positioned on bottom surface 60 of inside 34 of container device 16. In select embodiments of case 10 lined with liner material 38 to carry wigs 12, units 13, hair pieces 14, the like, and/or combinations thereof, liner material 38 may be positioned on left side 56 of inside 34 of container device 16. In select embodiments of case 10 lined with liner material 38 to carry wigs 12, units 13, hair pieces 14, the like, and/or combinations thereof, liner material 38 may be positioned on right side 58 of inside 34 of container device 16. In select embodiments of case 10 lined with liner material 38 to carry wigs 12, units 13, hair pieces 14, the like, and/or combinations thereof, liner material 38 may be positioned on back side 62 of inside 34 of container device 16. In select embodiments of case 10 lined with liner material 38 to carry wigs 12, units 13, hair pieces 14, the like, and/or combinations thereof, liner material 38 may be positioned on front side 64 of inside 34 of container device. In select embodiments of case 10 lined with liner material 38 to carry wigs 12, units 13, hair pieces 14, the like, and/or combinations thereof, liner material 38 may be positioned on bottom side 66 of hinged lid 24. In select embodiments of case 10 lined with liner material 38 to carry wigs 12, units 13, hair pieces 14, the like, and/or combinations thereof, liner material 38 may be positioned around each of the at least one divider 32. In select possibly preferred embodiments of case 10 lined with liner material 38 to carry wigs 12, units 13, hair pieces 14, the like, and/or combinations thereof, liner material 38 may be positioned: on bottom surface 60 of he inside 34 of container device 16; on left side 56 of inside 34 of container device 16; on right side 58 of inside 34 of container device 16; on back side 62 of inside 34 of container device 16; on bottom side 66 of hinged lid 24; on front side 64 of inside 34 of container device 16; and around each of the at least one dividers 32. In select embodiments of case 10 lined with liner material 38 to carry wigs 12, units 13, hair pieces 14, the like, and/or combinations thereof, liner material 38 may be padded fabric material 68. Padded fabric material 68 may be any padded fabric material, the like, etc., including, but not limited to, padded satin fabric material 70, as shown in the Figures.

Figure 4:
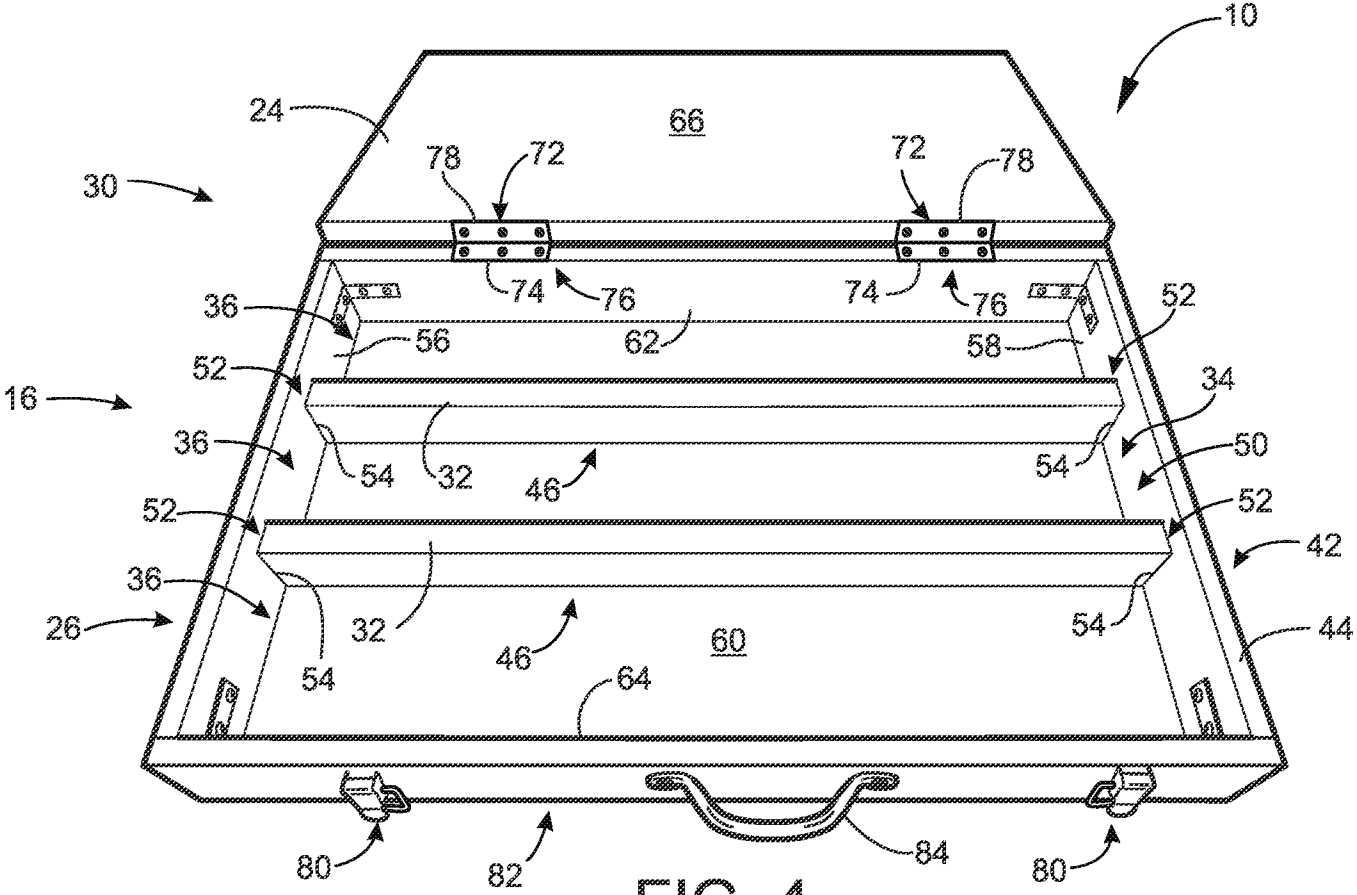
FIG. 4 is a top front perspective view of the disclosed case to carry hair pieces of FIG. 1 with the lid open showing the dividers on the inside with no liner material therein.
Figure 5:
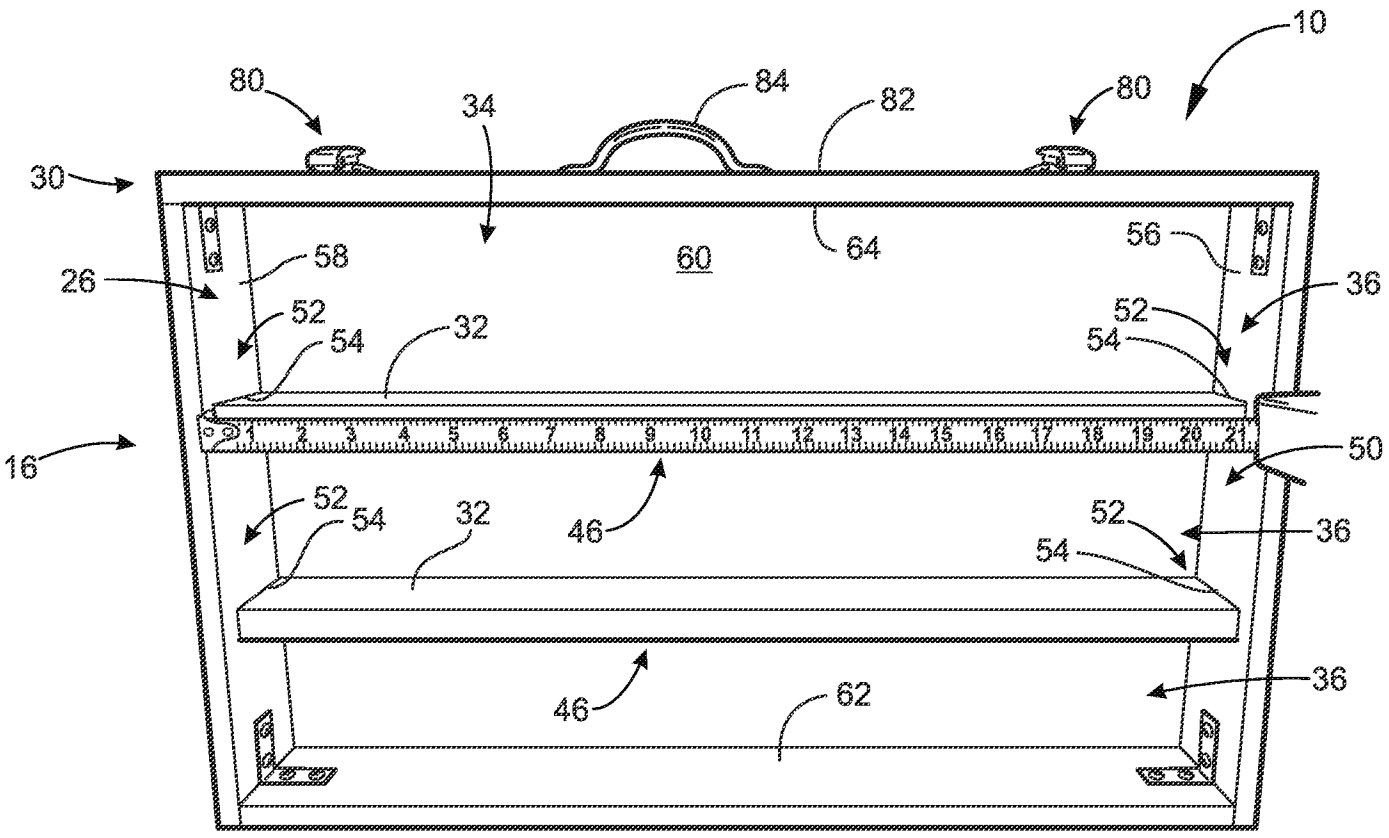
FIG. 5 is a top view of the disclosed case to carry hair pieces of FIG. 1 with the lid open showing two dividers on the inside with no liner material therein.
Figure 6:
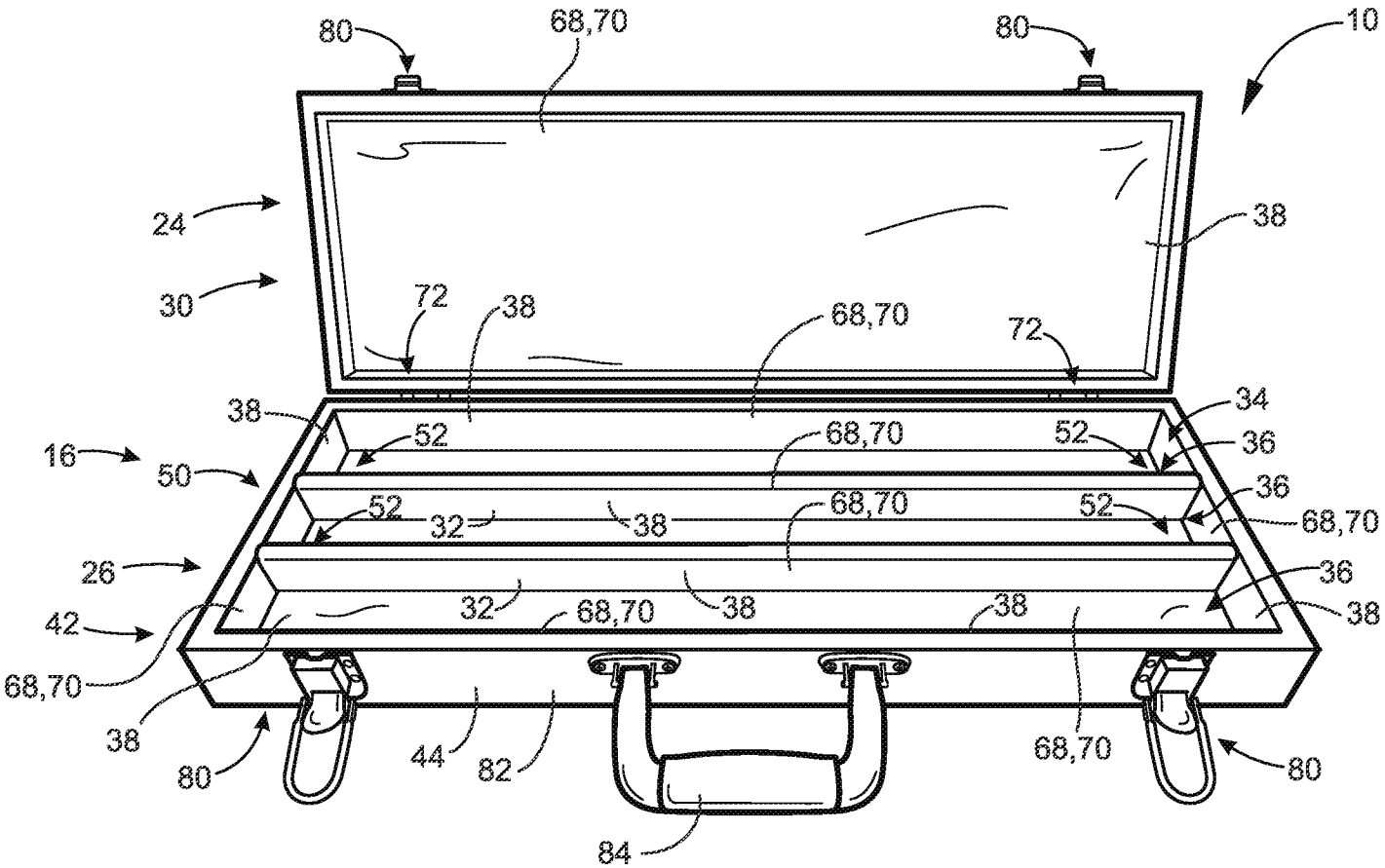
FIG. 6 is a top front perspective view of the disclosed case to carry hair pieces of FIG. 1 with the lid opened showing two dividers on the inside with liner material thereon.
Figure 7:
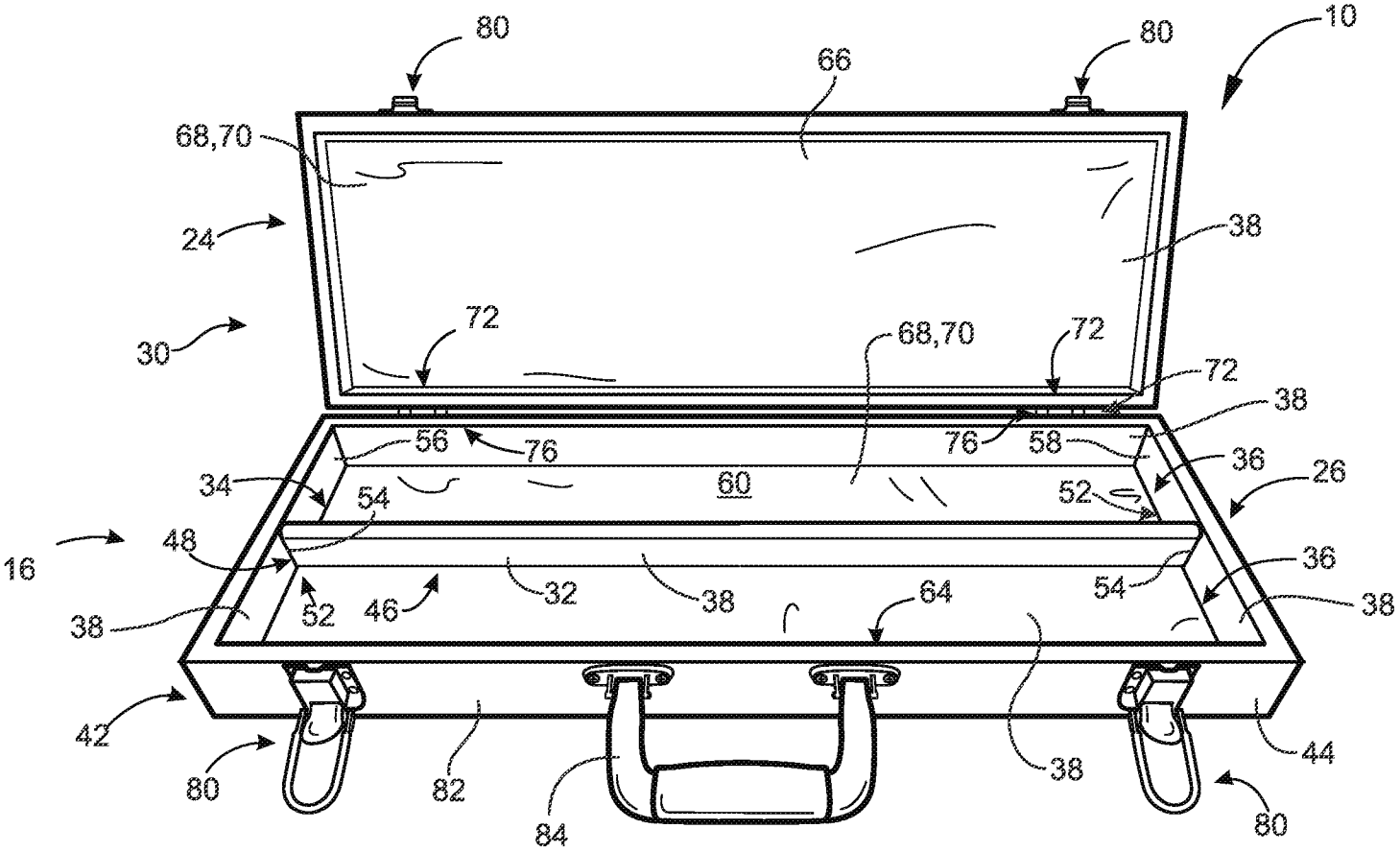
FIG. 7 is a top front perspective view of the disclosed case to carry hair pieces according to select embodiments of the instant disclosure with the lid opened showing one divider on the inside with liner material thereon.

Referring now to FIGS. 4 and 7, another feature of case 10 lined with liner material 38 to carry wigs 12, units 13, hair pieces 14, the like, and/or combinations may be that it can include at least one hinge 72. Hinge 72 or hinges 72 may be connected between back side 62 of container device 16 and hinged lid 24. In select embodiments, as shown in the Figures, 2 hinges 72 may be connected between back side 62 of container device 16 and hinged lid 24. In select embodiments, each of the at least one hinge 72 may include bottom portion 74 and top portion 78. Bottom portion 74 may be connected on or in groove 76 in back side 62 of inside 34 of container device 16. This may help conceal hinge 72 or hinges 72, like as shown in the Figures. Top portion 78 may be connected to hinged lid 24. Liner material 38 may be inserted over bottom portion 74 and/or top portion 78 for concealing hinges 72 on inside 34 of container device 16

As shown in the Figures, another feature of case 10 lined with liner material 38 to carry wigs 12, units 13, hair pieces 14, the like, and/or combinations thereof may be the inclusion of locking clasps 80. Locking clasps 80 may be configured to secure hinged lid 24 to open top portion 26 of container device 16. Locking clasps 80 may be any desired locks, clasps, or the like, designed and/or configured to secure hinged lid 24 to open top portion 26 of container device 16. In addition, locking clasps 80 may be positioned anywhere on case 10 configured for securing hinged lid 24 to open top portion 26 of container device 16 In select embodiments, locking clasps 80 may be positioned on front 82 of container device 16.

As shown in the Figures, another feature of case 10 lined with liner material 38 to carry wigs 12, units 13, hair pieces 14, the like, and/or combinations thereof may be the inclusion of handle 84. Handle 84 may be configured for carrying case 10. Handle 84 may be any desired handle or the like device configured to carry case 10. In addition, handle 84 may be positioned anywhere on case 10 configured for carrying case 10. In select embodiments, handle 84 may be positioned on front 82 of container device 16, similar to a standard brief case handle.

Figure 8:
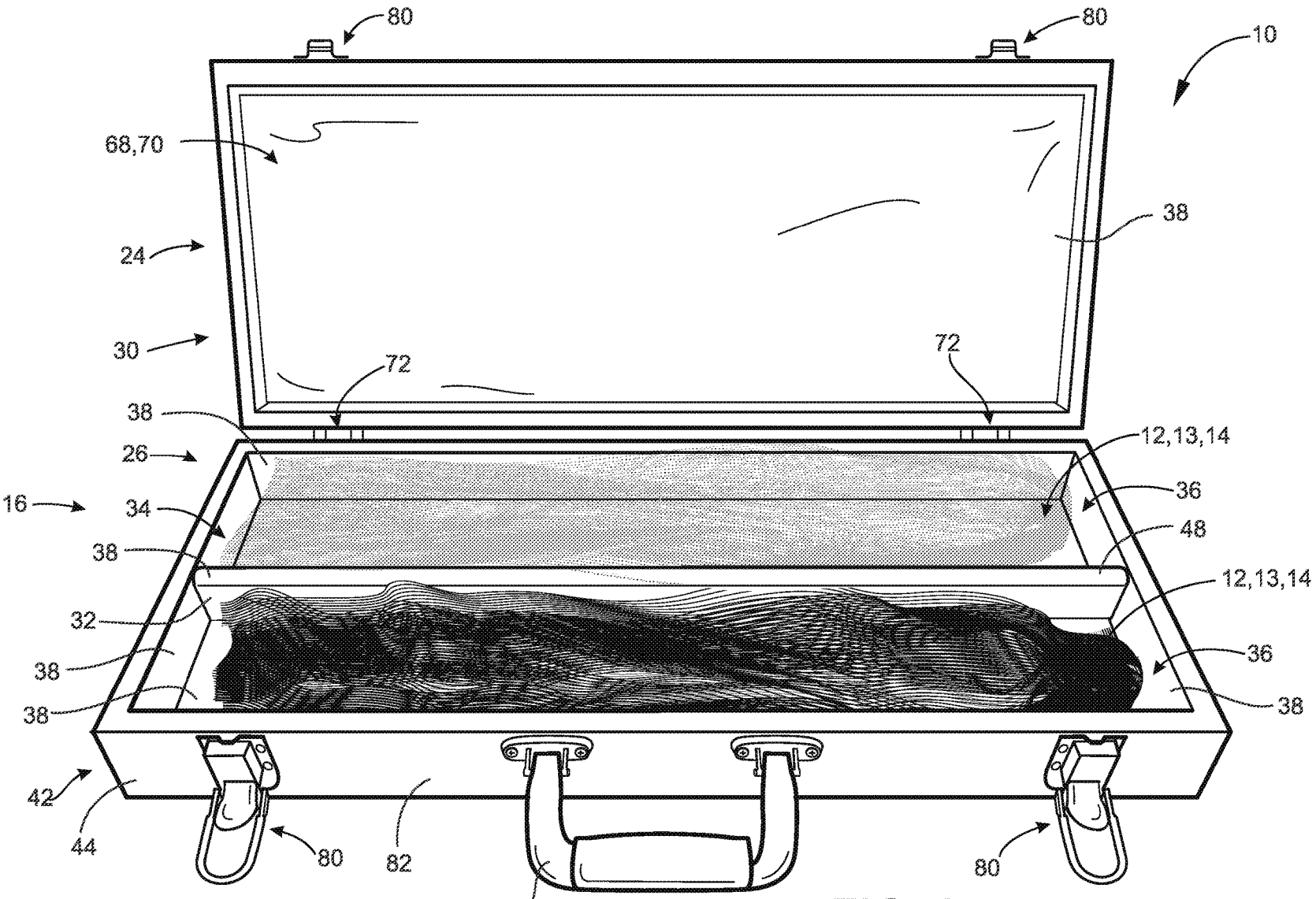
FIG. 8 is a top front perspective view of the disclosed case to carry hair pieces of FIG. 7 with the lid opened showing tone divider on the inside with liner material thereon, wish a wig, unit, or hair piece positioned in each compartment created by the one divider.
Figure 9:
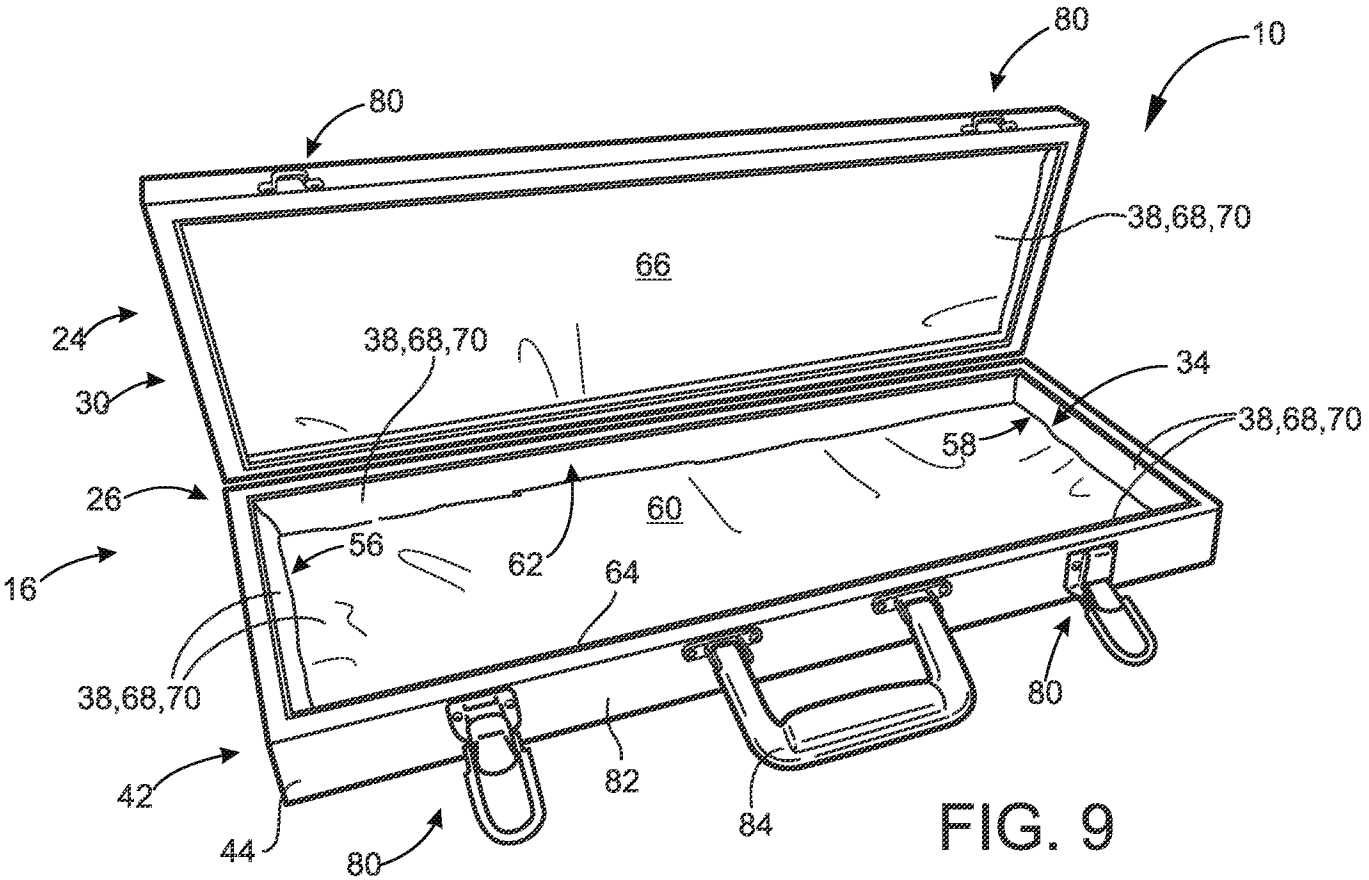
FIG. 9 is a top front perspective view of the disclosed case to carry hair pieces according to select embodiments of the instant disclosure with the lid opened showing the liner material therein with no dividers therein.
Figure 10:
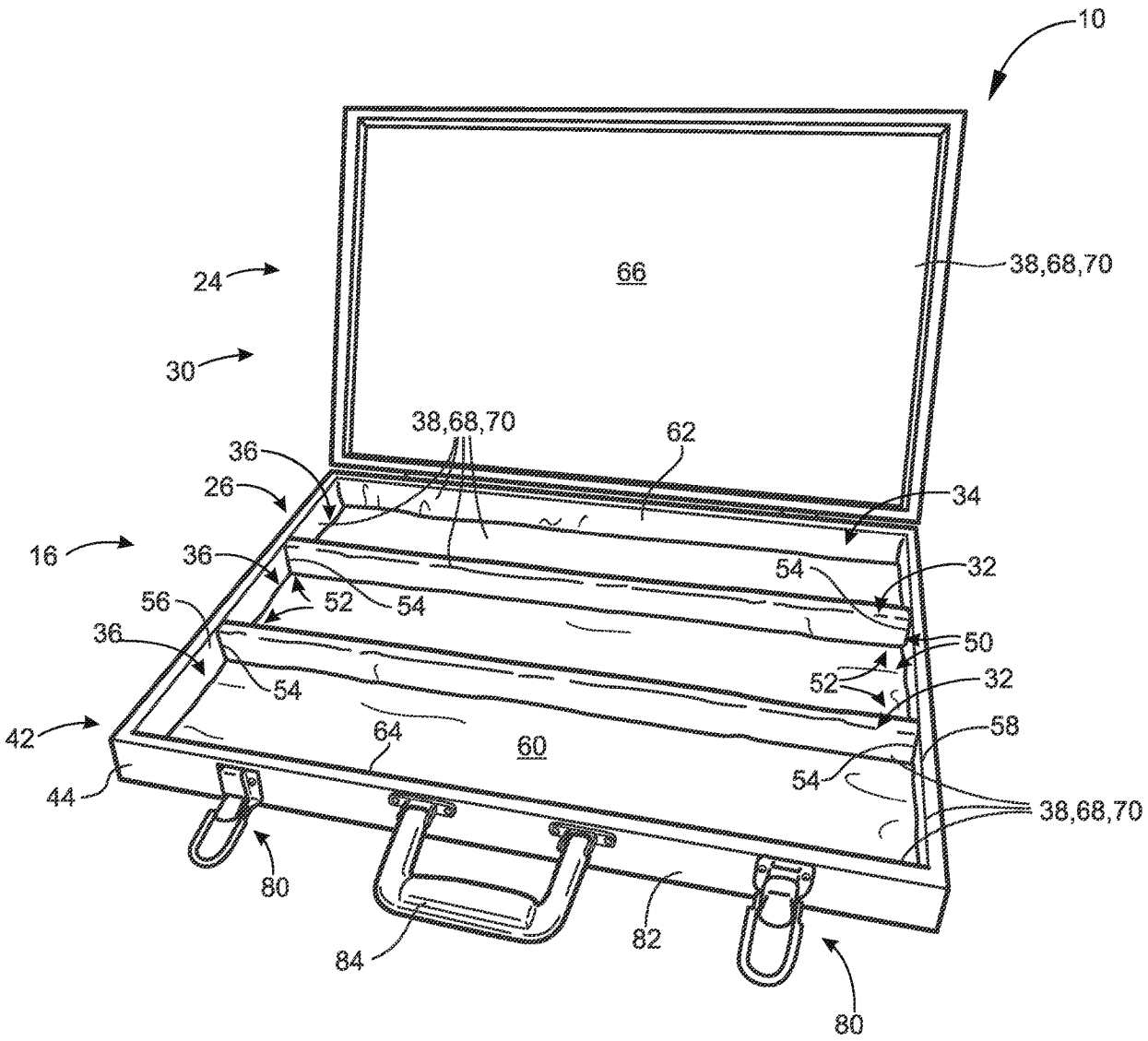
FIG. 10 is a top front perspective view of the disclosed case to carry hair pieces according to select embodiments with the lid open showing two dividers positioned therein and showing the liner material therein.
Figure 12:
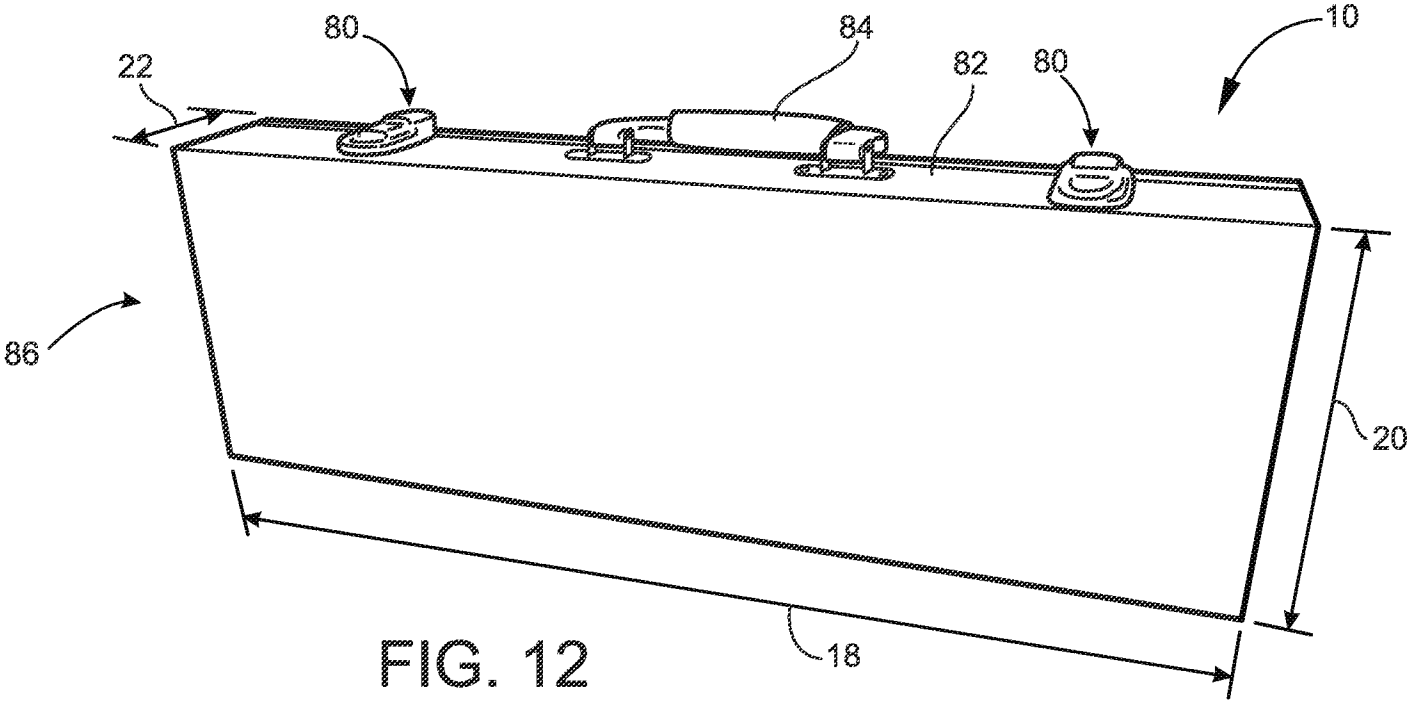
FIG. 12 is a top perspective view of the disclosed case to carry hair pieces according to select embodiments in a small embodiment or travel size or an airplane travel size.

Referring now specifically to FIG. 12, in select embodiments of case 10 lined with liner material 38 to carry wigs 12, units 13, hair pieces 14, the like, and/or combinations thereof, container device 16 may be configured as airplane travel size 86. Airplane travel size 86 may have length 18 of container device 16 of 22 inches and width 20 of container device 16 of 14 inches. In this airplane travel size 86 embodiment of handcrafted case 10, at least one divider 32 may be included. The at least one divider 32 may be configured for creating at least two compartments 36 on inside 34 of container device 16. In select embodiments of this airplane travel size 86 embodiment of handcrafted case 10, a single lengthwise divider 48 may be provided for creating two compartments 36 on inside 34 of container device 16, like as shown in FIGS. 7-8.

Figure 13:
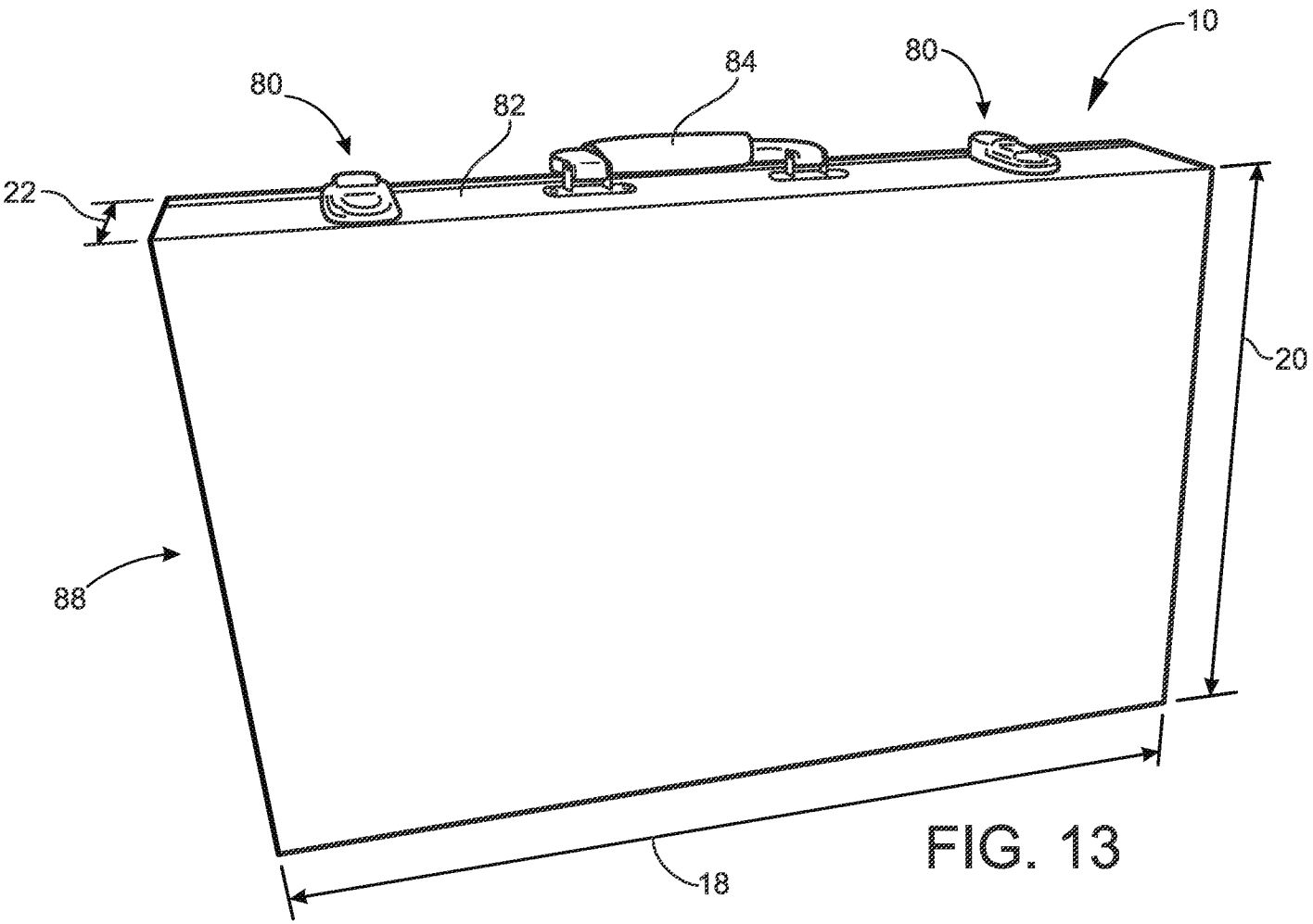
FIG. 13 is a top perspective view of the disclosed case to carry hair pieces according to select embodiments in a large embodiment or a standard case size.

Referring now specifically to FIG. 13, in select embodiments of case 10 lined with liner material 38 to carry wigs 12, units 13, hair pieces 14, the like, and/or combinations thereof, container device 16 may be configured as standard case size 88. Standard case size 88 may have length 18 of container device 16 of 22 inches and width 20 of container device 16 of 18 inches. In this standard case size 88 embodiment of handcrafted case 10, at least two dividers 32 may be included. The at least two dividers 32 may be configured for creating at least three compartments 36 on inside 34 of container device 16. In select embodiments of this standard case size 88 embodiment of handcrafted case 10, two lengthwise dividers 50 may be provided for creating three compartments 36 on inside 34 of container device 16, like as shown in FIGS. 4-6 and 10-11.

In sum, the disclosed handcrafted cases 10 lined with liner material 38 carry wigs 12, units 13, hair pieces 14, the like, and/or combinations thereof may be designed to provide a secure compartment that will allow such wigs 12, hair pieces 14 and/or units 13 to be stored and or used for traveling. A user may place the wig 12, unit 13 hair pieces 14, or combinations thereof, in the fabric lined case 10. Removable dividers 32 are provided to allow storage or carrying, including, but not limited to, up to 1 to 3 wigs, up to 5 to 6 units or 1 wig.

In operation, the person would open hinged lid 24 of case 1- and lay their selected wigs 12, units 13 and/or hair pieces 14 between the dividers 32 provided or remove the dividers 32 (see FIG. 9) and just place inside including, but not limited to, up to 3 wigs, units or hair pieces inside. The user would then close hinged lid 24 and use locking clasps 80 on the outside to clamp down and securely close hinged lid 24 to prevent the hair wigs 12, units 13 or hair pieces 14 from falling out.

An example of the disclosed handcrafted cases 10 lined with material 38 to carry wigs 12, units 13, and/or hair pieces 14 may include, but is not limited to 2 different size options: a 22×14 airplane travel size 86 (see FIG. 12); and a 22×18 standard case size 88 option as well. 2-3 dividers 32 can be inserted or removed by consumer to create compartments 36 to hold up to 3-4 wigs 12, units 13, and/or hair pieces. Case 10 may be painted inside and outside. Case 10 may include padded satin fabric material 70 as an inlay on inside 34 of container device 16. There may be different colors for both outside and inside.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. A case to carry wigs, units, and hair pieces comprising:

a container device with a length, a width, and a depth, the container device including a hinged lid on an open top portion, the hinged lid rotates between a closed position and an option position, where the closed position is configured to seal the open top portion, and the option position is configured to provide access to the open top portion;

at least one divider on an inside of the container device, the at least one divider is configured to divide the inside of the case into compartments, where each compartment is configured to store at least one of the wigs, the units, or the hair pieces, each of the at least one divider is oriented lengthwise inside of the container device along the length of the container device;

a liner material on the inside of the container device, the liner material is configured to protect the wigs, the units, the hair pieces, and a combination thereof stored in the inside of the container device, the liner material is a padded fabric material, wherein the liner material is positioned:

on a bottom surface of the inside of the container device;

on a left side of the inside of the container device;

on a right side of the inside of the container device;

on a back side of the inside of the container device;

on a bottom side of the hinged lid;

on a front side of the inside of the container device; and around each of the at least one divider, where each of the at least one divider is held in place in lengthwise orientation via frictional forces between ends of the divider and the liner material on left and right sides of the inside of the container device;

two hinges connected between a back side of the container device and the hinged lid, each of the two hinges including:

a bottom portion connected on a groove in a back side of the inside of the container device; and a top portion connected to the hinged lid;

locking clasps configured to secure the lid to the case, the locking clasps are positioned on a front of the container device;

a handle configured for carrying the case, the handle is positioned on a front of the container device;

wherein the container device being configured as:

an airplane travel size with the length of the container device being 22 inches and the width of the container device being 14 inches, where the airplane travel size including the at least one divider configured for creating at least two of the compartments; or a standard case size with the length of the container device being 22 inches and the width of the container device being 18 inches, where the standard case size including at least two dividers configured for creating at least three of the compartments;

wherein the case is configured to provide a secure and safe way to transport and store the wigs, the units, the hair pieces, or the combination thereof;

wherein the case is configured to be used to store and protect the wigs, the units, the hair pieces, or the combination thereof from dust and damage; and wherein the case is a handcrafted case made from wood.

* * * * *